United States Patent [19]

Markow

[11] Patent Number: 4,696,467

[45] Date of Patent: Sep. 29, 1987

[54] RIDABLE RECREATION DEVICE

[76] Inventor: Margaret Markow, 141 Connetquot Dr., Oakdale, N.Y. 11769

[21] Appl. No.: 831,487

[22] Filed: Feb. 20, 1986

[51] Int. Cl.[4] ..... A63B 25/08

[52] U.S. Cl. ..... 272/114

[58] Field of Search ..... 272/114, 52, 55, 56, 272/53.2, 1 D; 36/7.8

[56] References Cited

U.S. PATENT DOCUMENTS

| | | | |
|---|---|---|---|
| 1,587,749 | 6/1926 | Bierly | 272/114 X |
| 1,755,619 | 4/1930 | Westerlund | 272/52 |
| 1,850,927 | 3/1932 | Frederick | 272/55 |
| 2,993,530 | 7/1961 | Little et al. | 272/52 |
| 3,328,028 | 6/1967 | Williams | 272/114 |
| 4,081,182 | 3/1978 | O'Brien | 272/114 |
| 4,492,374 | 1/1985 | Lekhtman et al. | 272/114 |

FOREIGN PATENT DOCUMENTS

| | | | |
|---|---|---|---|
| 772780 | 8/1934 | France | 272/55 |
| 659280 | 10/1951 | United Kingdom | 272/114 |

*Primary Examiner*—Richard J. Apley
*Assistant Examiner*—James Prizant
*Attorney, Agent, or Firm*—Daniel Jay Tick

[57] ABSTRACT

A device that can be ridden for recreation and exercise. The device has an upright annular spring body member with a seat and a handle on the upper segment of the body annulus. In use, the rider straddles the device and with his feet planted on the riding surface, flexes his legs to impose his weight on the device to store energy therein. This cycle is followed by the rider extending his legs to release the stored energy. This jouncing sequence is repeated and the rhythmic build up of energy causes the device and its rider to be bouncingly propelled across the riding surface. In a second embodiment, stirrups are provided in the lower segment of the body annular for the rider's feet. In a third embodiment, the body member has supports for the rider's feet suspended from the seat.

16 Claims, 8 Drawing Figures

RIDABLE RECREATION DEVICE

BACKGROUND OF THE INVENTION

The present invention relates to recreational and exercising devices and, more particularly to a device that can be straddled and ridden for recreation and exercise.

Recreational devices upon which a rider can sit or straddle to bounce up and down for pleasure generally are of the hobby-horse type having a coil or cantilever spring-mounted chair or a replica of a horse or other animal. Typically, the rider can only bounce up and down in one spot and horizontal travel with the device is not effectively accomplished. In the prior art, a typical example of such a device is the hobby horse and support disclosed by A. M. Little et al in U.S. Pat. No. 2,993,530. However, the prior art in U.S. Pat. No. 4,081,182 to K. P. O'Brien also discloses that it is known to provide a ridable upright annular resilient recreation device which is capable of horizontal travel. This prior art device is ridden by a rider sitting on a seat portion with his legs astraddle the annular body member and by grasping a handle member and exerting repeating jumping motions against a pair of foot supports, causes the device to bounce across the riding surface. Unlike the present invention which has an efficient solid annular spring body member, the prior art K. P. O'Brien device has a hollow body which may be inflated with air or filled with a suitable resilient material such as an elastomeric foam. That prior art device thus is a visco-pneumatic structure having the inherent damping forces associated with such constructions. Because the solid resilient annular spring of the present invention is not subject to visco-pneumatic damping forces the recovery energy in its bounce response is significantly higher than in prior inflatable constructions. It is seen, therefore, that the spring rate of a pneumatic tube like structure is at least one order of magnitude lower than the solid annular spring member of the present invention and thus would only be a candidate for relatively young children weighing about 50 pounds or less.

BRIEF SUMMARY OF THE INVENTION

The present invention is a device that is ridden for recreation or exercise. The device has a thin solid resilient upright annular spring body member which can be provided in its uppermost segment with a saddle-like seat for a rider and handle means which the rider grips for support. A foot support extending from the seat or a stirrup-like arrangement on either side of the bottom segment of the annular spring means can be provided for use by the rider, or the rider can rest his feet on the surface on which the riding is going to be done. Deflection limiting means are also provided to avoid overstressing the spring member. In use, the rider straddles the device and then, by alternately storing energy in the annular spring member by flexing his legs to impose his weight thereon and then releasing the stored energy by extending his legs, causes the device and himself to be propelled bouncingly across the riding surface. An exercise sequence simulating horseback riding can be accomplished by a rider by placing his feet on the riding surface: then, with the device remaining in contact with the surface, the rider, by flexing and extending legs such that his weight is cyclically imposed on the device, initiates a vertical spring response in the device whereby the resulting rhythm and muscular responses tighten and tone the abdominal and thigh muscles of the rider. A less strenuous exercise routine can be accomplished by sitting "side saddle" on the annular spring device and alternately flexing and extending the legs to thereby exercise the heart and trunk muscles.

BRIEF DESCRIPTION OF THE DRAWINGS

In order that the invention may be readily carried into effect, it will now be described with reference to the accompanying drawings, wherein.

DETAILED DESCRIPTION OF PREFERRED EMBODIMENTS

Figure 1:
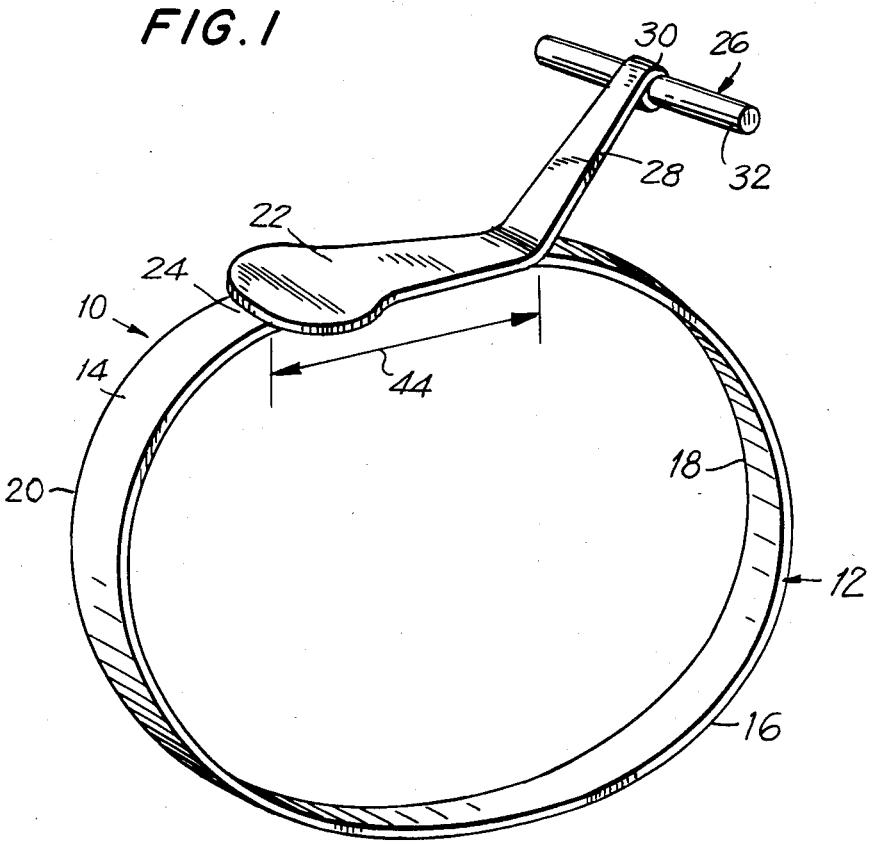
FIG. 1 is a perspective view of a first exemplary embodiment of the ridable recreation and exercise device of the invention.

With reference now to the drawings, FIG. 1 illustrates a first embodiment of the recreation device 10 of the invention. Device 10 has a thin upright annular spring or body member 12 which has an upper or top segment 14, a lower or bottom, segment 16, and a pair of opposing substantially ellipsoidal ends 18 and 20. An elongated saddle-like seat 22 is provided for the rider on the top surface 24 or upper segment 14 of the body member 12. Suitable cushioning means (not shown in the FIGS.) can be fitted on the seat for the comfort of the rider. A handle means 26 is provided for use as a manual support by the rider. The handle means has an upright stem 28 which is provided with a socket 30 fitted with a pair of transverse hand grips 32. It will be appreciated that, although a seat 22 and handle means can be provided, a successful exercise routine can be accomplished with or without a seat and with or without handle means.

Any suitable resilient spring material can be used for the annular body member 12, but a filament-wound composite compound consisting of high-strength glass fiber, Kevlar, or graphite a utilizing an epoxy or high-strength thermoplastic matrix is preferred. Each body member can be fabricated individually using a conventional filament-winding technique. A further method of fabrication suitable for high-volume production is a technique in which a long tube, which can range up to 40 feet in length, is filament wound in the same way fiberglass pipe is manufactured and a lathe operation is used to cut off lengths therefrom to produce the individual annular body members.

The annual body member suitably has a structural strength bending stress in the range of 130 to 160 kpsi, Young's modulus of 4 to $6\times10^3$ klbs in$^2$, and a minimum shear strength of 4 to 6 kpsi. Operating stress is limited by bottoming deflection to approximately 50% of ultimate stress. In fabricating the body member out of fiberglass, the resin content may be approximately between 25 to 35% by weight and filament winding angle of about $\pm5°$ from the pure circumferential may be used. The relatively high ultimate strength of an annular fiberglass structure made with the filament-winding process or by utilizing preimpregnated tapes create an energy storage system approximately six times better than SAE 1060 spring steel. In spite of this high bending strength, the failure mode of the annular member is benign and progressive. Small cracks propagate at the neutral axis of the annulus or compressive fiber separation occurs. Unlike an annular member made out of a brittle homogenous material, no instant breaks can occur with the composite member.

Figure 2:
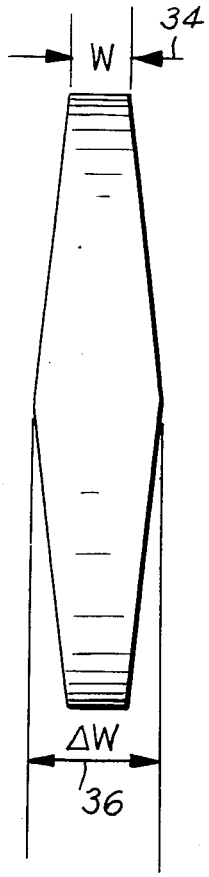
FIG. 2 is a front elevation of an embodiment of the annular spring body member of the invention.
Figure 3:
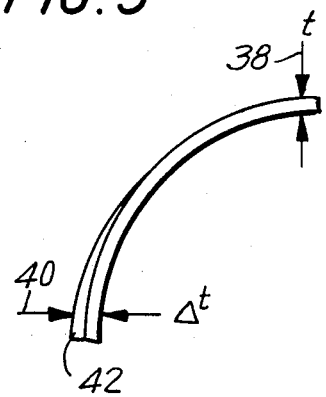
FIG. 3 is a fragmentary side elevation of an embodiment of the annular spring body member of the invention.

The stiffness characteristics EI (Young's modulus $\times$modulus of elasticity) of the annular body member 12 will vary between 5 and 10 klbs in$^2$ depending on the application. For example, a 22 in. diameter annular member whose EI flexural properties are in the range of 5 klbs in$^2$ would be suitable for a child weighing about 80 lb. A 150 lb adult would use a larger annular member ranging in diameter from 26 to 30 in. and having a section thickness resulting in an EI approximately 10 klbs in$^2$. Typical dimensions of the cross-section of the smaller annular member will be approximately 5.5 in. wide and 0.13 in. thick and 6 in. wide and 0.16 in. thick for the larger member. A spring rate between 20 and 30 lbs/in. appears desirable to attain a natural frequency between 1 and 2 cycles/sec. The natural frequency characteristic relates to the controllability of the bouncing annular member in repetitive cycles. However, the width and/or thickness of the annular section of the body member 12 can be varied if required to produce a non-linear spring rate or to obtain a more optimal stress distribution to thereby attain a structure of minimum weight. Thus, as indicated in FIG. 2, the width 34 of the annular body member can be increased locally 36 to achieve a specific spring rate or as indicated in FIG. 3, the thickness 38 can be increased locally 40 for the same purpose. The added thickness 40 can be implemented by a secondary bonding of preimpregnated glass, Kevlar, graphite or other appropriate tape 42. The length 44 of the base element of the elongated saddle-like seat 22 should be long enough and the seat should be fastened securely enough to the top surface 24 of the annular member to insure that there is a proper distribution of the load in use to prevent the member undergoing reverse bending under load that would lead to overstressing the member.

In use, the rider straddles the recreation device 10 and sits on seat 22, supporting his hands on hand grips 32 of the handle means. With his feet firmly placed on the riding surface on either side of the surface contact area of the device, the rider initiates motion with a cyclic jounce and he then rhythmically adds energy by extending his legs and flexing his torso. As this energy is increased, the device bounces off the surface and the rider can propel the device and himself in a "pogo stick" fashion. The body kinematics used by the rider of the device of the invention are similar to those used with a pogo stick. If the rider leans forward during the bouncing maneuver, the device will go forward; if he leans backward, or to the right or left, the traversing direction will be altered, respectively. The device is neutrally stable. A seat belt may be advisable for the more athletic application of the device.

With this device, the energy recovery is much higher than with conventional devices of this type because a larger percentage of the body mass is instantly reacted to by the elasticity of the loop, unlike the pogo stick or a trampoline where the energy absorptive characteristics of the body limbs and unsprung elements of the device decreases the amount going into the energy storing system. As compared with a pogo stick, the recreation device 10 provides a large ground contact enhancing energy recovery with the losses in deforming the soil being at a minimum. The device can thus be ridden on lawns, soft ground, and beaches, and does not require a hard surface for operation. Jumping is accomplished by the rider extending his legs in coordination with the release of energy stored in the deflected annular spring means of the device.

It is possible to use this device to simulate horseback riding and to exercise the same muscles involved therein. This exercise is conducted with the rider's feet placed on the floor or surface and with the device also maintained in constant contact therewith. The rider initiates an exercise cycle in the device by a rhythmic flexing of his legs to cause the weight of his body to deflect the annular spring body member to compress it and then extending his legs to release the energy stored by that deflection to produce a vertical spring response in the device. This vertical spring response produces similar rhythmic and muscular responses as those involved in horseback riding to beneficially exercise and tighten and tone the abdominal and thigh muscles of the rider.

Figure 4:
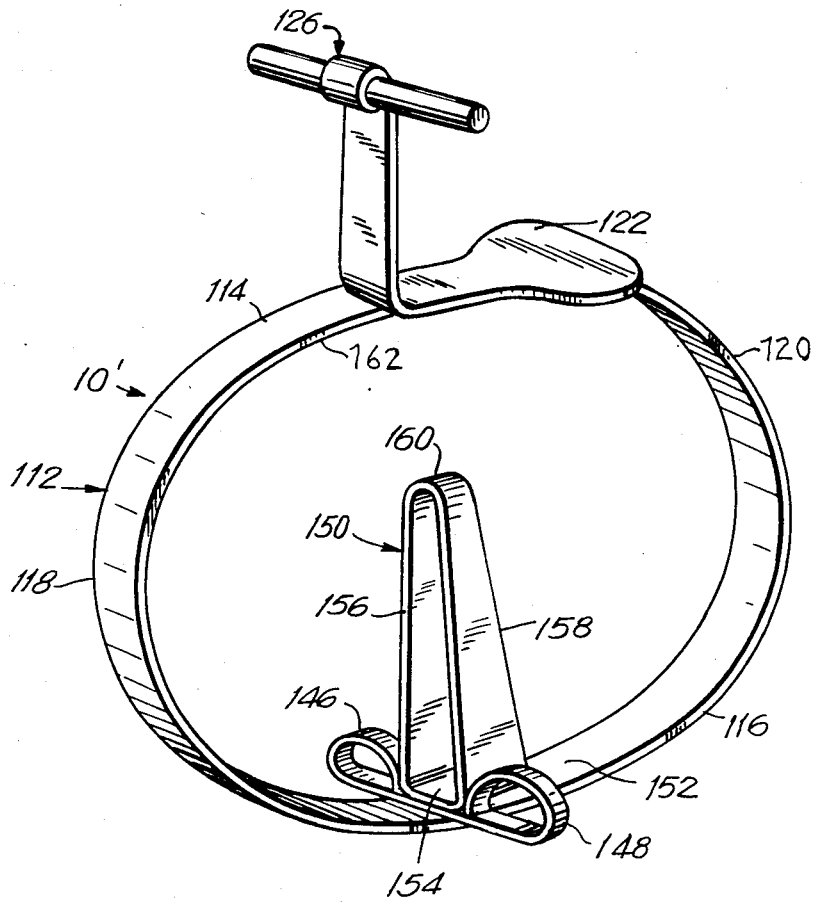
FIG. 4 is a perspective view of a second exemplary embodiment of the ridable recreation and exercise device of the invention.
Figure 5:
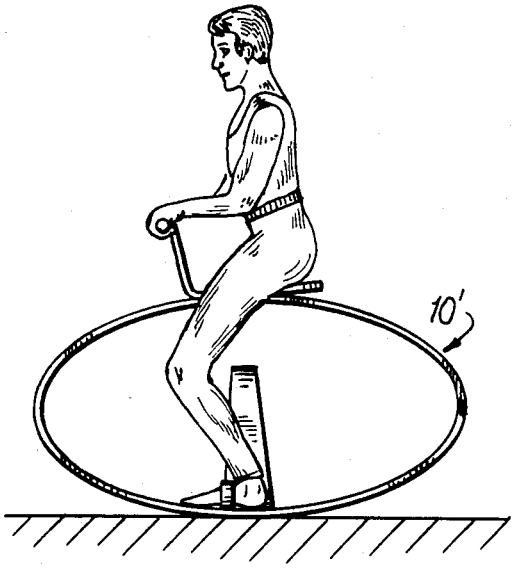
FIG. 5 is a side elevation of the device of FIG. 4 showing the position of a rider mounted thereon.

A further embodiment of the invention is the recreation device 10' shown in FIGS. 4 and 5. The device 10' has an upright annular spring body member 112 which has an upper segment 114, a lower segment 116, apair of opposing substantially ellipsoidal ends 118 and 120, an elongated saddle-like seat 122, and a handle means 126. It will be seen that recreation device 10' is identical to recreation device 10 embodied in FIG. 1 except that device 10' has a pair of stirrups 146 and 148 attached on either side of lower segment 116 and an upstanding stop structure 150 fixed on the inside surface 152 of the lower segment. Stop structure 150 has a base 154 fixed on the inside surface 152 of the lower segment 116 opposing wall members 156 and 158, and a top portion 160. The height of the stop structure is selected such that the bottoming of the inside surface 162 of the upper segment 114 against top portion 160 under load limits the deflection of the annular member to prevent its overstressing.

In operation, the device 10' is ridden exactly the same as the FIG. 1 embodiment of the invention, except that the rider can place his feet in the stirrups and use them in propelling the device and himself across the surface.

Figure 7:
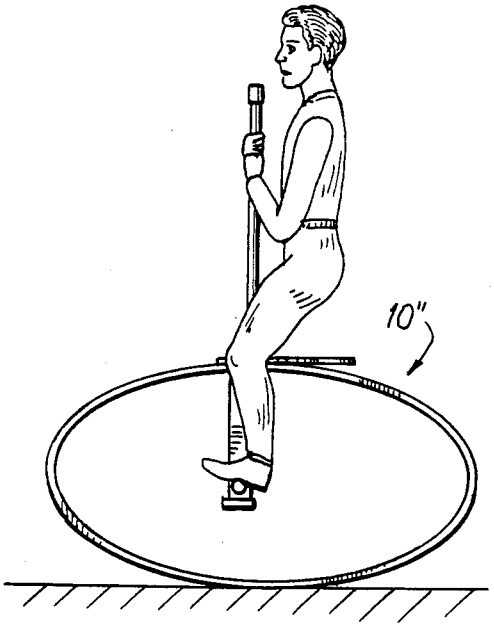
FIG. 7 is a side elevation of the device of FIG. 6 showing the position of a rider mounted thereon.
Figure 6:
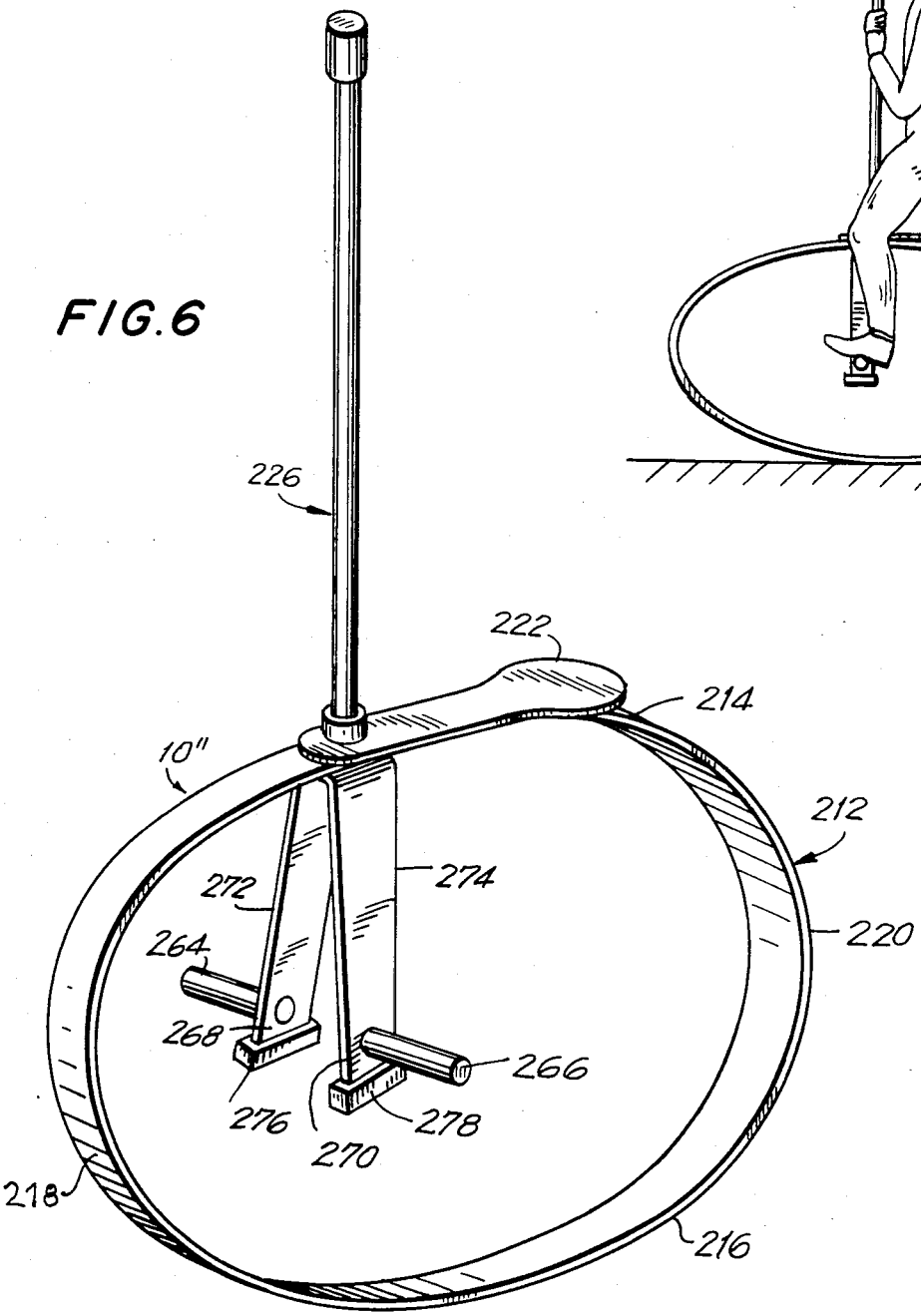
FIG. 6 is a perspective view of a third exemplary embodiment of the ridable recreation and exercise device of the invention.

A still further embodiment of the invention is the recreation device 10'' shown in FIGS. 6 and 7. Device 10'' has an upright annular spring body member 212 which has an upper segment 214, a lower segment 216, a pair of opposing substantially ellipsoidal ends 218 and 220, an elongated saddle-like seat 222, and a handle means 226. The recreation device 10'' in its basic constituent components is essentially the same as the previously described embodiments of the invention. It differs from those embodiments in that foot supports 264 and 266 are provided in the lower ends 268 and 270 of a pair of rigid struts 272 and 274 depending from either side of the seating means 222. It will be appreciated that each foot support can comprise a stirrup which encompasses the foot rather than the rod-like support illustrated in FIG. 6. The bottom ends 276 and 278 of the struts are used as stop means to limit the deflection of the annular spring member 212 under load to prevent overstressing the structure. In this embodiment also, an upright pogo-stick-like pole is employed as the handle means instead of the transverse handgrips of the previous embodiments.

In the FIG. 6 embodiment of the invention, the rider grasps the pole-like handle means 226 and straddles the device with his feet resting on the foot supports 264 and 266 and uses the same physical dynamics as employed with a pogo stick to propel himself and the device across the surface.

Figure 8:
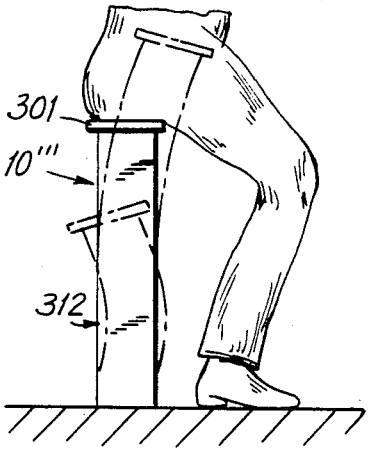
FIG. 8 is a front elevation of the device of the invention showing the position of a rider sitting transversely on the device.

A less strenuous but still beneficial exercise can be accomplished with the recreational device of the invention if the rider sits "side saddle" on the device. For this exercise routine, the recreation device 10''' indicted in FIG. 8 comprising a basic annular spring body member 312 can be used. Although a fixed seat or handle means is not incorporated, a pad or other cushioning means 301 can be provided for the comfort of the rider or user. In this exercise routine, the rider sits transversely on the device with his feet spread apart and placed firmly on the surface. In this position, a stable 3-point support is acquired. The rider initiates substantially vertically directed oscillations in the device by alternately flexing and then tightening his legs. The torsional flexibility of the thin structural loop-like body member in addition to its primary bending flexibility accommodates this motion. When the exercises are done in this manner, the vertical oscillations stress and tone both the stomach and thigh muscles. This exercise routine as well as the other exercises accomplished with the recreation devices of this invention are an excellent cardiovascular conditioning activity.

Although shown and described in what are believed to be the most practical and preferred embodiments, it is apparent that departures from the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

I claim:

1. A device adapted to be ridden for recreation or exercise, said device having resilient means for propelling said device bouncingly across the riding surface comprising:

a thin solid resilient upright non-metallic annular spring body member having its axis located in the horizontal plane, said spring member having an upper top segment, a lower bottom segment in direct contact with a reacting directly against the surface on which the device is to be ridden, and a pair of opposing substantially ellipsoidal ends, the distance between said ends being less than the distance between said upper and said lower segments, said annular spring having nearly constant flexural and stiffness properties throughout the entire annulus;

handle means to be grasped for support by the rider of said device, said handle means being fixed at least on said upper segment; and seat means fixed on the radially outer surface of said upper segment proximate said handle means such that said device can be straddled by a rider with his feet in contact with the riding surface and wherein the elasticity of said spring member is such that said rider, by following an operating sequence in which he stores energy in the spring member by flexing his legs to impose his weight thereon and releases said energy to do work by extending his legs, can use the elasticity of said spring member to propel the device and himself bouncingly across said surface.

2. A device adapted to be ridden for recreation or exercise, said device having resilient means for propelling said device bouncingly across the riding surface comprising:

a thin solid resilient upright non-metallic annular spring body member having an upper segment, a lower segment in direct contact with and reacting directly against the surface on which the device is to be ridden, and a pair of opposing substantially ellipsoidal ends, said annular spring having nearly constant flexural and stiffness properties throughout the entire annulus;

seating means on said upper segment; and handle means proximate said seating means, wherein said device can be straddled and said handle means used for support and wherein the elasticity of said spring member is such that a rider by following an operating sequence in which he stores energy in the spring member by bending his legs to impose his weight thereon and releases said energy to do work by extending his legs, can use the elasticity of said spring member to cause the device and himself to be propelled bouncingly across said surface.

3. A device as claimed in claim 2, further comprising rigid struts depending from the seating means and a foot support on each strut on the lower end thereof, and wherein the ends of said struts serve to limit the deflection of said spring member under load.

4. A device as claimed in claim 2, wherein said seating means has a rigid planar base portion having a length sufficient to prevent reverse bending in said annular spring member under load.

5. A device as claimed in claim 2, wherein said handle means has an upstanding central support portion with handgrips projecting transversely on either side of the upper end thereof.

6. A device as claimed in claim 3, wherein said foot support is a stirrup which encompasses the foot.

7. A device adapted to be ridden for recreation or exercise, said device having resilient means for producing vertically directed oscillations, and wherein said resilient means comprises:

a single continuous one-piece thin solid resilient upright non-metallic annular spring serving as a body member and having an upper segment for the seating of a rider and a lower segment in direct contact with and reacting directly against the surface upon which the device is to be ridden, said annular spring having nearly constant flexural and stiffness properties throughout the entire annulus, wherein said device can be mounted by a rider and wherein the elasticity of said spring member is such that said rider, following an operating sequence in which energy is stored in the spring member by bending his legs to impose his weight thereon and releasing said energy to do work by straightening his legs can use the elasticity of said spring member to produce substantially vertically directed oscillations of said device and said rider.

8. A device as claimed in claim 1, wherein the stiffness EI (Young's modulus times the modulus of elasticity) of the annular spring member ranges between about 5 and 10 klbs $in^2$.

9. A device as claimed in claim 1, wherein the rider sits transversely on said device with both feet spaced apart on one side of said device and placed firmly on the riding surface and remaining in constant contact therewith such that a 3-point support is established and wherein the elasticity of said annular spring body member is such that the dynamic physical input of said rider produces a substantially vertical spring response by said device that stress and tone the stomach, thigh, and other muscles of said rider.

10. A device as claimed in claim 1, wherein the section thickness of said annular spring member is varied to obtain a non-linear spring rate and a more optimal stress distribution such that the weight of said annular spring member can be reduced.

11. A device as claimed in claim 1, wherein, with the riders feet placed on the riding surface and with said device remaining in constant contact therewith, the elasticity of said annular spring body member is such that the dynamic physical input of the rider produces a vertical spring response by said device that simulates horseback riding so that the rhythm and muscular responses elicited thereby exercise and tighten the abdominal and thigh muscles of the rider.

12. A device as claimed in claim 1, wherein the section width of said annular spring member is varied to obtain a non-linear spring rate and a more optimal stress distribution such that the weight of said annular spring member can be reduced.

13. A device as claimed in claim 1, further comprising a stirrup which encompasses the foot, said stirrup being fixed on each side of said annular spring member on the lower segment thereof.

14. A device as claimed in claim 13, further comprising a vertical upstanding rigid stop structure on the inside surface of the lower segment of said annular spring member to limit its deflection under load.

15. A device as claimed in claim 8, wherein the spring rate of the annular spring member is selected such that the cyclic bouncing rate thereof is controlled, and wherein a natural frequency between one and two cycles per second is attained with a spring rate between 20 and 30 $lbs/in^2$.

16. A device as claimed in claim 8, wherein the diameter of the annular spring member ranges between 20 to 30 in.

* * * * *